US005888077A

United States Patent [19]

Champion et al.

[11] Patent Number: 5,888,077

[45] Date of Patent: Mar. 30, 1999

[54] CONNECTOR ASSEMBLY AND POWER CONTACT ELEMENT

[75] Inventors: Patrick Champion, Change, France; Danny Morlion, St. Amands Berg; Werner Panis, Tessenderlo, both of Belgium; Jacky Thenaisie, Le Mans, France; Jan Peter Karel Van Koetsem, Zwijndrecht; Luc Jonckheere, Bilbeek, both of Belgium

[73] Assignee: Framatome Connectors International, Courbevoie, France

[21] Appl. No.: 903,135

[22] Filed: Jul. 30, 1997

[30] Foreign Application Priority Data

Aug. 2, 1996 [FR] France ..... 96 09817

[51] Int. Cl.[6] ..... H01R 4/66

[52] U.S. Cl. ..... 439/108; 439/660

[58] Field of Search ..... 439/108, 101, 439/608, 660

[56] References Cited

U.S. PATENT DOCUMENTS

| | | | |
|---|---|---|---|
| 4,405,189 | 9/1983 | Douty et al. | 339/17 C |
| 4,726,787 | 2/1988 | Stine | 439/510 |
| 5,161,987 | 11/1992 | Sinisi | 439/108 |
| 5,183,405 | 2/1993 | Elicker et al. | 439/108 |
| 5,409,406 | 4/1995 | McClure | 439/857 |

FOREIGN PATENT DOCUMENTS

| | | |
|---|---|---|
| 0459680 A2 | 12/1991 | European Pat. Off. . |
| 0658951 A1 | 6/1995 | European Pat. Off. . |

*Primary Examiner*—Gary Paumen
*Assistant Examiner*—Antoine Ngandjui
*Attorney, Agent, or Firm*—Perman & Green, LLP

[57] ABSTRACT

A connector assembly comprises a first connector (1) and a second connector (2) adapted to be mated with the first connector. Each connector has two spaced rows of contact elements (4,10) arranged at a given pitch, each of the contact elements having a contact face (6). In the first connector (1) at least two adjacent contact elements (4) of one row of contact elements are made integral as one first power contact element (13) having two contact faces (6) at the given pitch. In the second connector (2) at least one contact element (10) of one row of contact elements can be made integral with an opposite contact element (10) of the other row of contact elements as one second power contact element (14).

7 Claims, 3 Drawing Sheets

CONNECTOR ASSEMBLY AND POWER CONTACT ELEMENT

BACKGROUND OF THE INVENTION

The present invention generally relates to a connector assembly, for example a board-to-board connector assembly, and to power contact elements to be used in such a connector assembly.

In connector assemblies, in particular in board-to-board connector assemblies, used in telephone and computer systems for example, it is important to miniaturize the connectors and contact elements. With increasing miniaturization, the size of the contact elements may become too small to meet the power requirements of the electronic components connected through the connector assembly.

It is a general object of the present invention to provide a connector assembly wherein relatively high power requirements can be met despite the small size of the contact elements used and the small pitch of the contact elements.

BRIEF SUMMARY OF THE INVENTION

According to the invention a connector assembly is provided, comprising a first connector and a second connector adapted to be mated with said first connector, each connector having two spaced rows of contact elements arranged at a given pitch, each of said contact elements having a contact face, characterized in that in said first connector at least two adjacent contact elements of one row of contact elements are made integral as one first power contact element, having two contact faces at said pitch.

In an alternative embodiment, in said second connector at least one contact element of one row of contact elements is made integral with an opposite contact element of the other row of contact elements as one second power contact element.

In this manner a miniaturized connector assembly can be provided wherein high power requirements can be met.

The invention also provides a first power contact element, comprising one leg with two contact portions each having a contact face, and two further legs joining said one leg and having a width less than half the width of said one leg.

Further, the invention provides a second power contact element, comprising two mainly n-shaped parts with a first leg, a second leg and an intermediate section interconnecting said first and second legs, wherein said first leg is made as a contact spring and said second leg is made as a fastening element for fastening the contact element in a connector housing, the intermediate sections of said two n-shaped parts being interconnected.

BRIEF DESCRIPTION OF THE DRAWINGS

The invention will be further explained by reference to the drawings in which embodiments of the connector assembly and power contact elements according to the invention are shown.

DETAILED DESCRIPTION OF THE PREFERRED EMBODIMENT

Figure 1:
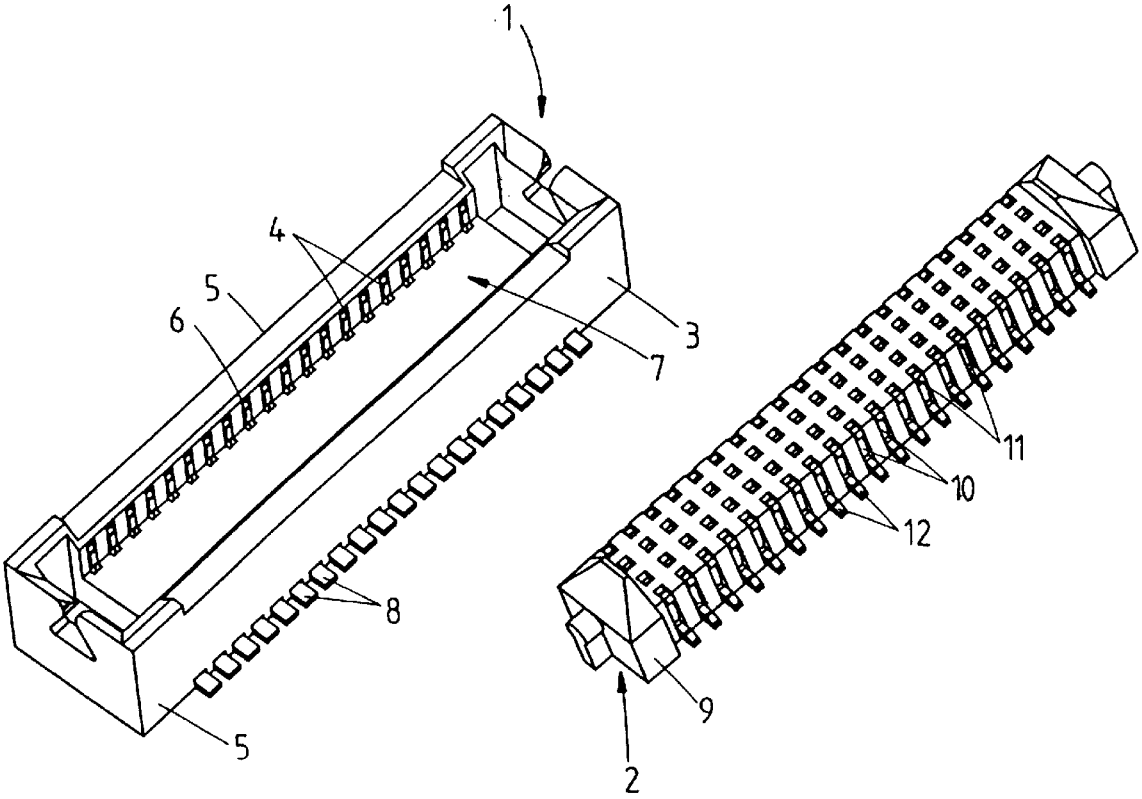
FIG. 1 is a perspective view of an embodiment of the connector assembly according to the invention, wherein the first and second connectors are shown separately from their top side.

FIG. 1 shows a connector assembly comprising a first connector 1 and a second connector 2 adapted to be mated with the first connector 1. The connector 1 includes a first housing 3 having two rows of first contact elements 4 arranged at a given pitch, said rows of contact elements 4 lying at a distance from each other along the longitudinal walls 5 of the housing 3. Each contact element 4 comprises a a contact face 6 projecting into a receiving space 7 of the first housing 3. The first contact elements 4 are disclosed in a patent application of the same date of the same applicant which is deemed to be incorporated here by reference; application Ser. No. 08/903,140. As described in this application, each contact element 4 is provided with two legs, one leg having said contact face 6 and the other leg having a connection terminal 8 for surface mount connection to a contact area of a printed circuit board not shown.

The second connector 2 comprises a second housing with two rows of second contact elements 10 arranged at said given pitch. These second contact elements 10 are also described in a patent application of the same date of the same applicant which is incorporated here by reference; application Ser. No. 08/903,140. As described in this patent application each second contact element 10 comprises a contact portion 11 projecting from the corresponding longitudinal side of the second housing 9 and a connection terminal 12 for surface mount connection to a contact area of a printed circuit board not shown.

Figure 2:
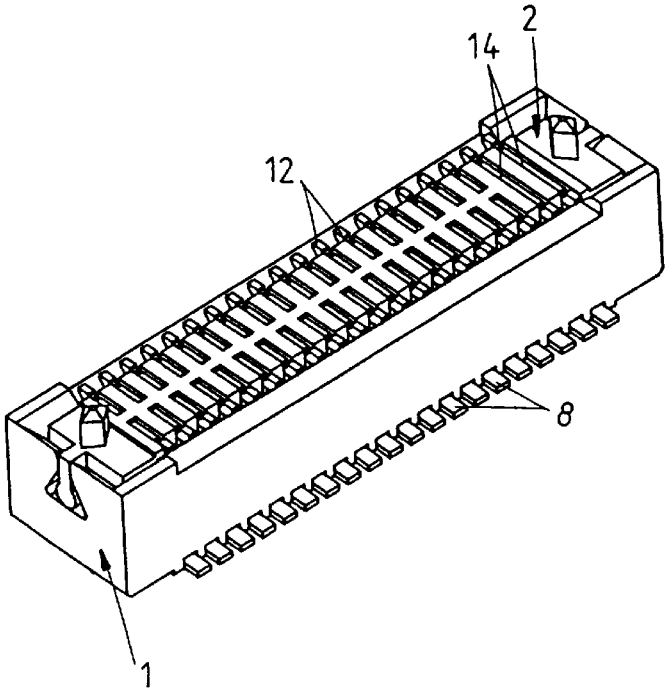
FIG. 2 is a perspective view of the connector assembly of FIG. 1, wherein the connectors are mated.

For mating the connectors 1 and 2, the connector 2 is inserted into the receiving space 7 of connector 1 as shown in FIG. 2. In this mated position of the connectors 1, 2, corresponding contact elements 4 and 10 are interconnected. The contact elements 4, 10 are for example arranged at a pitch of 1 mm. The height of the first housing 3 may for example be 5 mm and the height of the second housing may for example be 2.4 mm. It will be understood that with such dimensions, the size of the contact elements may be too small to use the contact elements for power connections.

Figure 3:
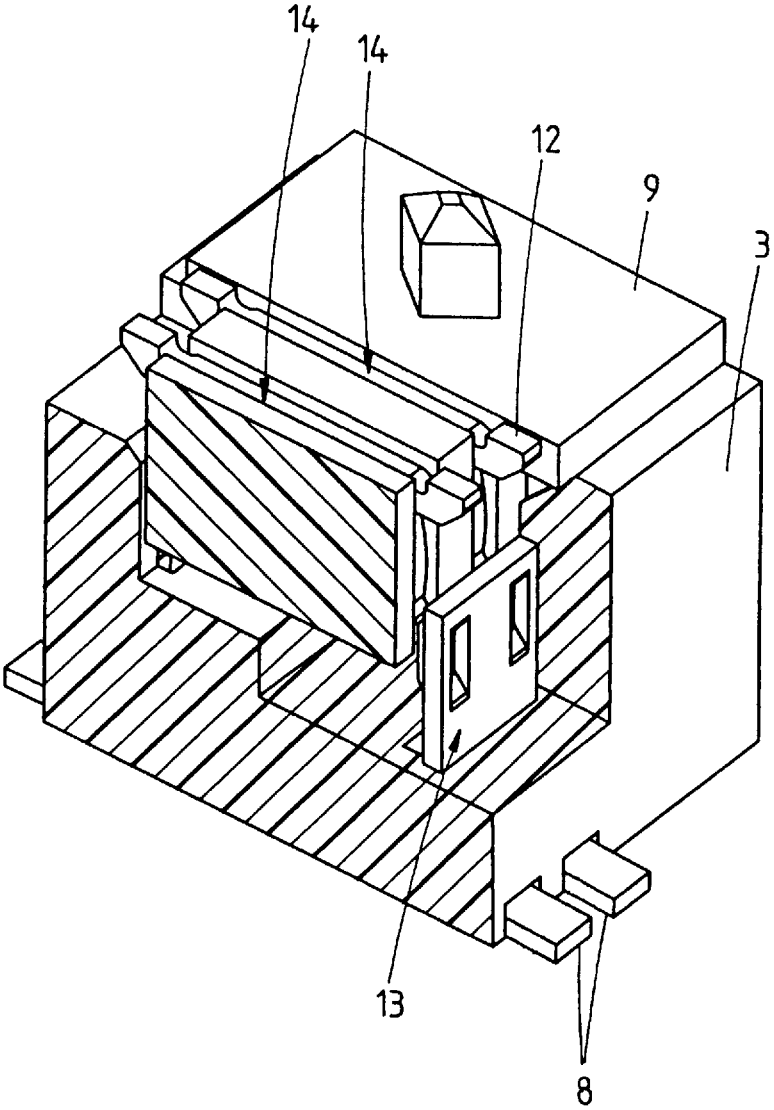
FIG. 3 shows a cross-section of the connector assembly of FIG. 1, wherein the first and second connectors are mated and wherein the housing of one of said connectors is partially cut-away.
Figure 4:
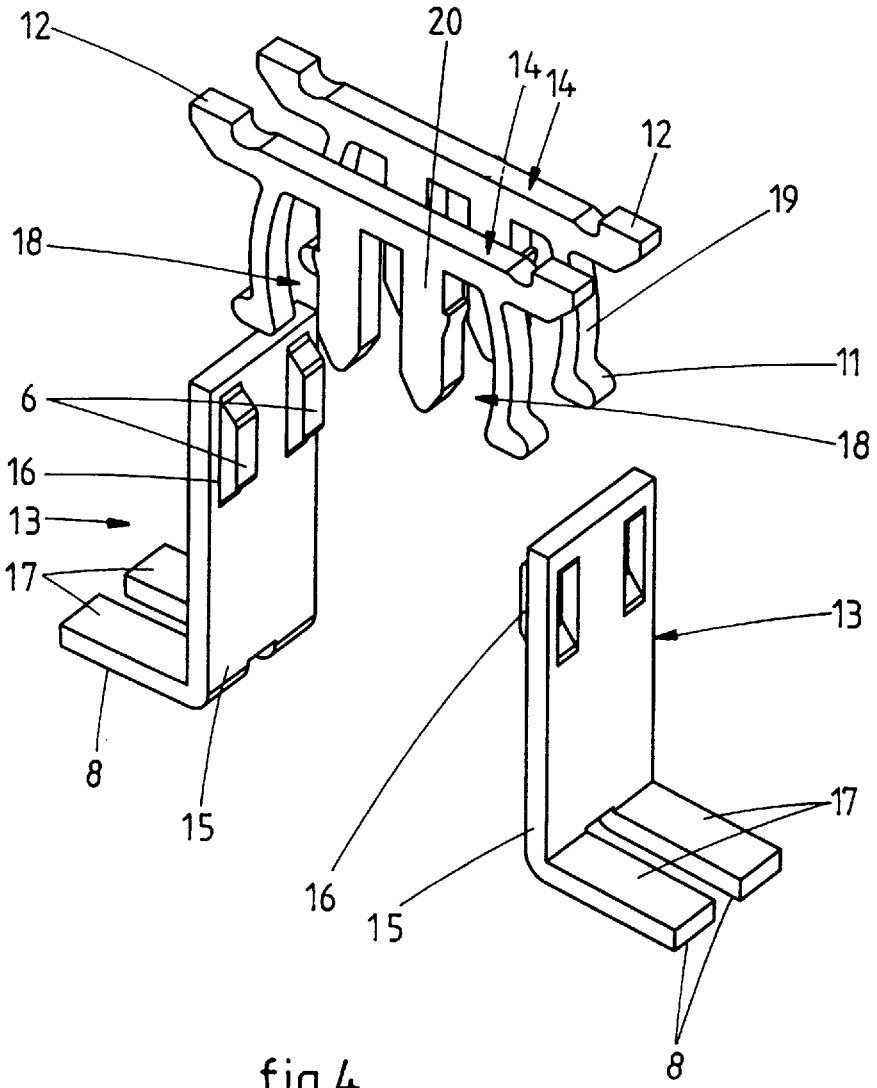
FIG. 4 is a perspective view of four power contact elements of the connector assembly of FIG. 1.

In the connector assembly described, the connectors 1, 2 can still be used for power connections by incorporating special power contact elements 13 in connector 1 (see FIG. 3) and special power contact elements 14 in connector 2 (see FIGS. 2 and 4). The power contact elements 13, 14 are shown in detail in FIGS. 3 and 4.

As shown in these FIGS. 3 and 4, the first connector 1 is provided with two first power contact elements 13, one power contact element 13 in each row at opposite locations. Each power contact 13 comprises a leg 15 with two contact portions 16 each having a contact face 6. Two further legs 17 join the leg 15 and each have a width less than half the width of the leg 15. Each leg 17 has a connection terminal 8.

Further, each power contact 14 comprises two mainly n-shaped parts 18, each part 18 having a leg 19 made as a contact spring and having the contact portion 11. Further, each n-shaped part 18 has a fixation leg 20 with a cam for locking the contact element 14 in the second housing 9. The legs 19, 20 are interconnected by an intermediate section having an extension with the connection terminal 12. The intermediate sections of both n-shaped parts 18 are interconnected.

In this manner a power connection through four first contact elements 4 and four second contact elements 10 is obtained. It will be understood that different combinations of power contact elements 13 and 14 are possible. For example, providing one power contact element 14 will result in a power connection through two first contact elements 4 and two second contact elements 10. Further it is possible to combine three or more adjacent first contact elements 4 into one power contact element 13.

The invention is not restricted to the above-described embodiment which can be varied in a number of ways within the scope of the claims.

What is claimed is:

1. Connector assembly, comprising a first connector and a second connector adapted to be mated with said first connector, each connector having two spaced rows of contact elements arranged at a given pitch, each of said contact elements having a contact face, all the contact faces in each respective row facing a same direction, characterized in that in said first connector at least two adjacent contact elements of one of said rows of contact elements are made integral as one first power contact element, having two of the contact faces at said pitch facing the same direction as the contact faces of the other contact elements in that row.

2. Connector assembly according to the preamble of claim 1, characterized in that in said second connector at least one contact element of one row of contact elements is made integral with an opposite contact element of the other row of contact elements as one second power contact element.

3. Connector assembly according to claim 1, wherein in said first connector each row of contact elements has at least two adjacent contact elements made integral as one first power contact element with two adjacent contact faces in said pitch in each row, said first power contact elements lying opposite one another, and wherein in said second connector at least two adjacent contact elements of one row of contact elements are made integral with corresponding contact elements of the other row of contact elements to obtain two adjacent second power contact elements, said two second power contact elements lying at locations corresponding to the locations of the contact faces of the opposite first power contact elements.

4. Connector assembly according to claim 1, wherein each contact element of the first connector comprises a first leg and a second leg joining said first leg, wherein said first leg is provided with a contact portion having said contact face and projecting with respect to said first leg, said contact portion being formed out of said first leg, wherein in each first power contact element the first legs of said two adjacent contact elements are made integral as one leg.

5. Connector assembly according to claim 1, wherein each contact element of the second connector comprises a mainly n-shaped part with a first leg, a second leg and an intermediate section interconnecting said first and second legs, wherein said first leg is made as a contact spring and said second leg is made as a fastening element for fastening the contact element in a connector housing, wherein in each second power contact element the intermediate sections of said two opposite contact elements are interconnected.

6. Power contact element, comprising a one-piece member having two mainly n-shaped parts, each n-shaped part having a first leg, a second leg and an intermediate section interconnecting said first and second legs, wherein each of said first legs are made as a contact spring having contact faces facing outward opposite directions and said second legs are made as a fastening element for fastening the contact element in a connector housing, and wherein the intermediate sections of said two n-shaped parts are interconnected.

7. An electrical power contact comprising a general L-shaped member having a first leg section of the general L shape with two projecting contact faces on one side and a second leg section of the general L shape being perpendicular to the first leg section, the second leg section having two parallel second legs, each of the second legs having a width less than half a width of the first leg.

* * * * *